United States Patent [19]

Cyphert

[11] 4,019,218

[45] Apr. 26, 1977

[54] CARPET SOIL EXTRACTOR

[75] Inventor: Gilbert G. Cyphert, Glendale, Ariz.

[73] Assignee: Chemko Industries, Inc., Phoenix, Ariz.

[22] Filed: Apr. 15, 1976

[21] Appl. No.: 677,264

[52] U.S. Cl. ..... 15/321; 15/322; 15/339; 15/352; 15/353

[51] Int. Cl.[2] ..... A47L 7/00

[58] Field of Search ..... 15/320, 321, 322, 339, 15/352, 353

[56] References Cited

UNITED STATES PATENTS

| | | | |
|---|---|---|---|
| 873,300 | 12/1907 | Cranston | 15/339 X |
| 2,531,370 | 11/1950 | Thompson | 15/321 |
| 2,949,620 | 8/1960 | Noble | 15/321 X |
| 3,063,082 | 11/1962 | Rosenberg | 15/353 X |
| 3,840,935 | 10/1974 | Fitzgerald, Jr. et al. | 15/322 |
| 3,848,291 | 11/1974 | Morse | 15/322 |

*Primary Examiner*—Christopher K. Moore
*Attorney, Agent, or Firm*—Cahill, Sutton & Thomas

[57] ABSTRACT

A self contained carpet soil extractor having a carrier for a cleaning solution, waste water and an attached floor wand for cleaning the carpet requires only an external connection to a source of electricity. The cleaning solution is directed through nozzles within the wand to scrub and permeate the pile of the carpet. An agitator brush within the wand, in combination with the chemical action of the cleaning solution, loosens embedded dirt. A source of vacuum within a mouth of the wand draws the resulting mixture of cleaning solution and dirt from the carpet and conveys the mixture into the waste tank of the carrier.

11 Claims, 5 Drawing Figures

CARPET SOIL EXTRACTOR

The present invention is an improvement of a device described in an application for U.S. Patent entitled "Carpet Soil Extractor", filed on Feb. 5, 1975, and assigned Ser. No. 547,139, now U.S. Pat. No. 3,959,844, and describing an earlier invention of the present inventor.

The present invention relates to carpet cleaning machinery and, more particularly, to self contained carpet soil extractors.

It is well known that carpets which are cleaned regularly not only have a better appearance but also wear significantly longer than carpets that are permitted to carry traffic while soiled. Much of the particulate matter which forms a part of the dirt within a carpet is abrasive in nature. Continual traffic upon a dirty carpet tends to cause the abrasive particulate matter to abraid the pile and backing of the carpet; furthermore, all of the dirt is continually forced deeper and deeper into the carpet.

Although it is possible to pick up a carpet and transport it to a facility for cleaning, many carpets cannot, as a practical matter, by feasibly removed from their location. Wall to wall carpet installations are somewhat permanent in nature and it is not contemplated that once such a carpet is installed that it would be removed for cleaning or other purposes. Also, a carpet which covers an extremely large area would be too heavy and too different to remove temporarily. It can be readily understood that in many installations, it is particularly advantageous if the carpet can be cleaned in situ rather than being removed to a distant point for cleaning.

Many cleaning methods apply water to the carpet being cleaned. Unless great care is taken, the water can create substantial problems. Among these problems are: the backing material of many carpets shrinks or decomposes if allowed to remain wet; underlying surfaces such as oak flooring, are ruined by water; if the dye is not waterfast, it will run or fade; all normal traffic must be rerouted for a substantial period of time since the wet carpet cannot be walked upon; and, all furniture must be removed from the entire carpet surface while the carpet is drying.

Considering the practicality of using water to clean a carpet and considering the many disadvantages of having the water saturate the carpet or stay on the carpet for a significant period of time, it may be appreciated that an effective and preferred carpet cleaning apparatus would be one which is capable of removing the applied water from the carpet completely and immediately.

It is well known to distribute a mixture of cleaning agent and water on the surface of a carpet, agitate the mixture into the pile of the carpet to loosen the retained dirt and then vacuum the combination of dirt and mixture from the carpet surface. Commonly, the application and extraction of the mixture are separate operations. The first operation loosens the dirt from the carpet pile and the second operation removes the mixture and dirt from the carpet. U.S. Pat. No. 3,699,607, discloses a carpet cleaning apparatus employing the method described above. Therein a plurality of nozzles direct a flow of water at an angle into the pile of the carpet. A rotary brush agitates the pile to loosen the dirt. A vacuum or suction chamber picks up the water and any entrained dirt. Great care must be employed in using this apparatus since the powered brushes are capable of permanently damaging the pile. Moreover, a separate vacuum source is employed which increases the complexity and weight of the apparatus and renders it more cumbersome.

It is therefore a primary object of the present invention to provide a carpet soil extractor which injects a mixture of water and cleaning solution into a carpet and immediately thereafter draws the mixture and any dislodged dirt from the carpet to leave the carpet substantially dry at the conclusion of the cleaning process.

Another object of the present invention is to provide a carrier for containing the cleaning solution, the waste water, fluid pump and a source of vacuum, a connected wand for discharging the cleaning solution into a carpet and drawing a mixture of cleaning solution and dirt from the carpet and a hose interconnecting the carrier and the wand.

Yet another object of the present invention is to provide a wand for a carpet soil extractor having a weighted single piece head for supporting all of the operative elements within the wand.

Still another object of the present invention is to provide a wand for a carpet soil extractor which automatically agitates the pile of a carpet to loosen and remove the dirt entrained therein upon a single pass across the carpet.

A further object of the present invention is to provide a carrier for a carpet soil extractor which supports a pivotable container for rapid and facile disposal of the waste water.

A yet further object of the present invention is to provide a manually operated wand for a carpet soil extractor which automatically burrows into the pile of a carpet to effect deep soil extraction without damaging the carpet.

A still further object of the present invention is to provide a portable self contained carpet soil extractor which needs only an external source of electrical power.

A still further object of the present invention is to provide a carpet soil extractor with a non-rotating brush for agitating and loosening dirt entrained within the pile of the carpet.

These and other objects of the present invention will become apparent to those skilled in the art as the description thereof proceeds.

The present invention may be described with greater specificity and clarity with reference to the following drawings, in which.

Figure 1:
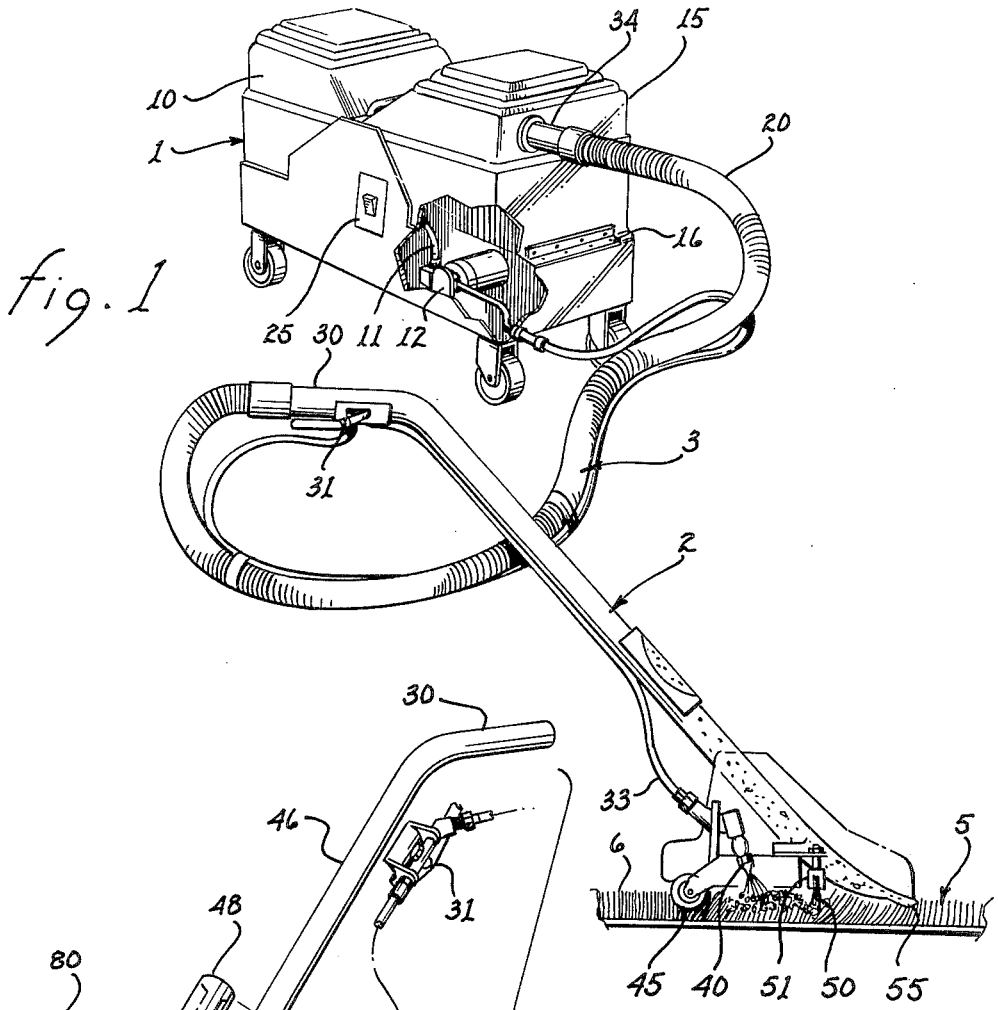
FIG. 1 is a perspective view of a carpet soil extractor having a carrier, a wand and an interconnecting hose assembly.

As illustrated in FIG. 1, the carpet soil extractor includes a carrier 1 connected to a wand 2 by means of a dual hose assembly 3. A tank 10 containing the cleaning solution is nested within one end of the carrier. The cleaning solution is conveyed from tank 10 through a conduit 11 into a pump assembly 12 wherefrom it is pumped to wand 2 through hose 13 of hose assembly 3. A waste tank 15 nests within the other side of carrier 1 and is pivotally attached to the carrier by hinge 16; this hinge permits tipping of the tank to empty it into a bucket or other waste disposal containers. A vacuum pump assembly mounted on the carrier creates a low pressure environment (hereinafter referred to as a vacuum in the vernacular of the trade) within waste tank 15. Vacuum hose 20 of hose assembly 3 interconnects wand 2 with inflow pipe 34 extending from waste tank 15 to render the mouth of the wand in fluid communication with the tank.

Before proceeding with a detailed description of the individual components of the present invention, it may be beneficial in understanding their relationship and operative interaction to briefly review the operation of the carpet soil extractor. The carpet soil extractor is energized by switching an electrical switch 25 from a first state to a second state to energize pump assembly 12 and the vacuum pump assembly (not shown in FIG. 1). Hand grip 30 is grasped by an operator to pull wand 2 across pile 6 of a carpet 5. On depressing solution release valve 31, the cleaning solution, under pressure from pump assembly 12, will flow through hose 13 into wand 2 and be ejected through nozzles 40. The force of the ejected cleaning solution will tend to cause the surrounding pile of the carpet to become permeated with the cleaning solution; scrubbing of the pile will also occur due to the force of the ejected fluid. By simultaneously pulling wand 2 toward the operator (the wand supporting wheels 45 lead), downwardly oriented bristles 50 of brush 51 agitate and scrub the cleaning solution permeated pile. Thereafter, the agitated and scrubbed pile comes under the influence of mouth 55 of the wand, which mouth is in fluid communication with waste tank 15 through hose 20. The vacuum pump assembly disposed within carrier 1 and connected to waste tank 15 establishes a vacuum at mouth 55. Thereby, the force of the cleaning solution ejected from the nozzles wets and initially washes pile 6 followed closely by the scrubbing action of brush 51. The vacuum at the mouth of wand 2 draws the dirt entrained free standing cleaning solution from the pile and draws practically all of the dirt entrained moisture permeated within the pile itself. Thereby, the carpet soil extractor removes embedded dirt to clean the carpet with a single pass of the wand and leaves the carpet dry enough to permit normal evaporation to render the carpet useable within 2 to 4 hours.

Figure 2:
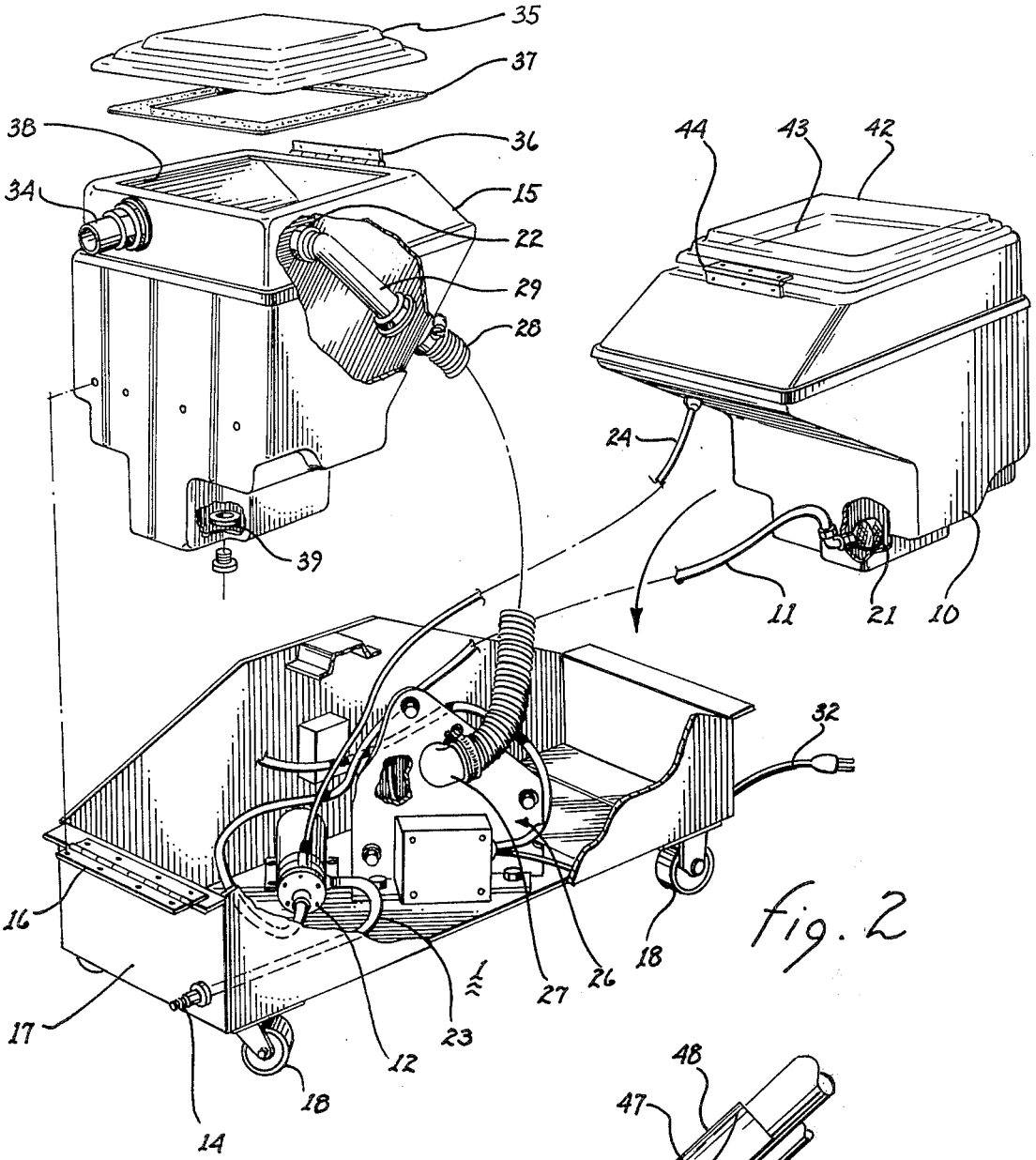
FIG. 2 is an isometric view of the major components of the carrier.

The carrier itself will be discussed in greater detail with reference to FIG. 2. A frame 17 for supporting and containing the operative elements of the carrier is mounted upon a set of wheels 18, whereby the carrier is rendered readily mobile. A power cord 32, connected to a source of electrical power, supplies electrical energy to the electrically powered components. Pump assembly 12 is mounted internal to frame 17 to draw the cleaning solution from tank 10 through filter 21 and conduit 11. An air vent tube 24 extending from the tank to the pump assembly may be employed. The fluid output of the pump assembly is transmitted through a further conduit 23, which conduit ultimately is attached to hose 13 by coupling 14.

Tank 10 is normally simply supported within frame 17 of the carrier. A transparent cover 42 extends across opening 43 and is pivotally retained in place by hinge 44. The cover provides access to the tank for refilling it with the cleaning solution.

A vacuum pump assembly 26 develops a source of vacuum within inlet 27. The inlet is in fluid communication with the interior of tank 15 via a flexible hose 28. The hose is coupled to an intake pipe 29, which pipe has an inlet opening within the upper part of tank 15 and may include a filter 22. Thereby, the vacuum pump assembly draws air from within tank 15 to establish a vacuum therein. An inflow pipe 34 extends from the upper end of tank 15 and is coupled to vacuum hose 20 (see FIG. 1). Thereby, the vacuum established within tank 15 is transmitted to the head of wand 2. To establish a seal about opening 38, cover 35 is pivotally attached to tank 15 by hinge 36 and sealingly engages gasket 37 disposed about opening 38. To drain the tank, vacuum hose 20 is disconnected from pipe 34 and the tank is pivoted or tipped about hinge 36 until all of the waste water within the tank has drained out through pipe 34. A drain assembly 39 may be incorporated to aid in cleaning and complete drainage of the tank.

Tanks 10 and 15 may be of the type illustrated and described in U.S. Pat No. Des. 239,811, issued May 11, 1976, and entitled "Recovery Tank for Carpet Cleaning Apparatus" which describes an invention by the present inventor.

Suitable electrical wiring, support brackets and enclosures are disposed within carrier 2 to properly safeguard the elements disposed therein and to preclude potential hazards to an operator.

Figure 3:
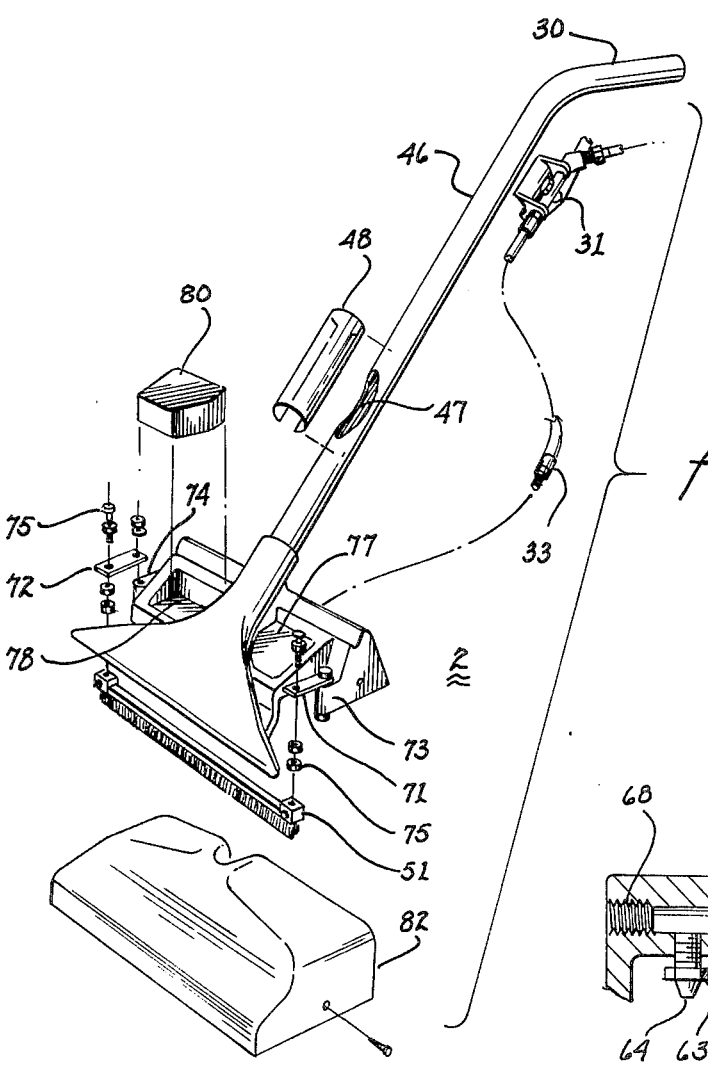
FIG. 3 is an isometric view of the wand.
Figure 5:
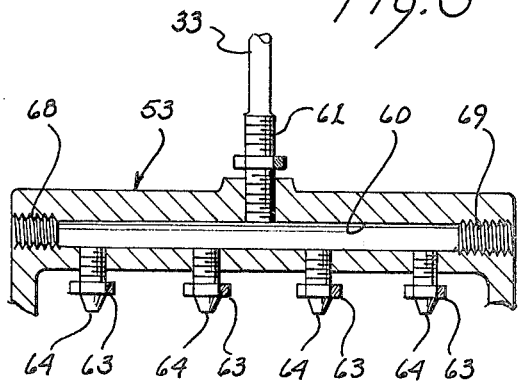
FIG. 5 is a cross-sectional view taken along lines 5—5, as shown in FIG. 4.
Figure 4:
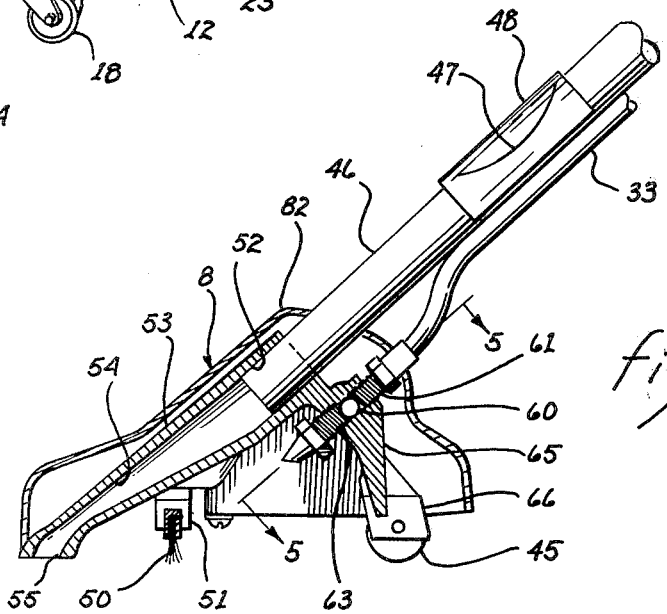
FIG. 4 is a cross-sectional view of the head of the wand.

Wand 2 will be discussed with primary reference to FIGS. 3, 4 and 5. Hand grip 30 is part of handle 46 which receivingly connects to vacuum hose 20. The lower end of hollow handle 46 is in sealing engagement with a cylindrical exhaust opening 52 of a casting 53. The casting is developed with a fanshaped compartment 54 extending from exhaust opening 52 to a generally rectangular shaped slot forming mouth 55. Thereby, fluid communication is established intermediate tank 15 and the mouth. As an option, an aperture 47, covered by a transparent split sleeve 48, may be employed to serve as a sight hole for inspecting the color and content of the fluid conveyed through the handle. Solution release valve 31, formed as part of hand grip 30, controls the flow of cleaning solution from hose 13, through hose 33, and into orifice assembly 61.

A transversely oriented passageway 60 within casting 53 is at the rear of exhaust opening 52 and extends for the full width of the casting. This passageway serves as a plenum chamber for distributing the inflowing cleaning fluid from a single orifice assembly 61 to each of a plurality of exhaust nozzles 63.

Plenum chamber 60, initially cast or drilled as a circular passageway extending through the upper rear of casting 53, is developed by permanently or threadedly inserting plugs 68 and 69 into the opposed ends of the passageway. Nozzles 63, are threadedly secured to casting 53 such that they may be periodically replaced, such replacement being necessary due to wearing of the exhaust orifice by the passage therethrough of the cleaning solution. Exhaust orifices 64 are specifically configured to provide a high velocity fan-shaped spray which forcefully penetrates the pile of the carpet and simultaneously exerts sufficient force to dislodge attached nodules of dirt from the pile.

A skirt 65 depending downwardly and rearwardly from passageway 60 supports mounting brackets 66 for wheels 45.

A pair of spring plates 71 and 72 are secured to and extend forwardly of shoulders 73 and 74 formed within the base of casting 8. Nut and bolt means or similar attachment devices may be employed to secure the plates to their respective shoulders. A downwardly oriented brush 51 is secured to the forward extremities of plates 71 and 72 by nut and bolt means 75 or similar attachment devices. In the preferred positioning of brush 51, the lower extremity of bristles 50 lie in the plane defined by the lowermost point of wheels 45 and mouth 55. In this planar relationship, the bristles will tend to exert maximum scrubbing and agitation force upon the carpet to be cleaned without bearing down upon the carpet so hard as to cause premature wear of the bristles or damage to the pile of the carpet. Moreover, the spring mounting of the brush tends to permit the brush to be vertically reciprocated by irregularities in the surface over which it travels and yet exert an essentially even pressure for scrubbing and agitation purposes.

A pair of trays 77 and 78 are formed within casting 8. These trays are particularly adapted to receive additional weights, such as weight 80. Thereby, the weight of the wand, pivoting about wheels 45 can be modified to exert a predetermined degree of pressure upon the surface over which it travels, which pressure is dependent upon the texture and resiliency of the surface. It may be well to point out that the manually exerted movement of wand 2 is primarily that of causing the wand to travel across the surface to be cleaned and little or no manual force is necessary to press the head onto or into the surface to be cleaned.

A cover 82 is attached to casting 53 for aesthetic purposes. Furthermore, the cover, being generally of plastic material, will tend to prevent scuffing or marring of wall boards and the like with which head 8 might otherwise come into contact during normal use.

Quick connect fittings are employed intermediate wand 2 and hose assembly 3 and carrier 2. Thereby, the three major components can be readily engaged and disengaged with one another.

By having all of the operative elements of head 8 formed as a part of or directly attached to a single casting, the physical orientation and the relative alignment therebetween are admirably well retained despite hard use and expected abuse of the wand. The resulting modular like construction tends to maintain operation of the wand at a high degree of reliability and substantially reduces the amount of periodic maintenance that must be performed per time period.

As the ejection of cleaning solution is independent of the operation of the vacuuming or suction capability of the wand, it is possible to render the cleaned carpet near dry despite any special tendencies of the carpet to retain the liquid solution by simply passing the wand across the carpet one or more extra times with the solution release valve in the closed position.

In summary, after engaging hose assembly 3 with carrier 1 and wand 2, cleaning solution tank 10 is filled and power cord 32 is plugged into a convenient electrical outlet. On actuation of switch 25, the vacuum pump assembly is energized which produces a vacuum or suction at mouth 55 of the wand. Simultaneously, pump assembly 12 is energized. On actuation of solution release valve 31, cleaning solution is pumped through hose 13, and hose 33 into plenum chamber 60 of the wand. The cleaning solution is sprayed through orifices 64 of nozzles 63 onto and into the pile of the carpet being cleaned. By manually maneuvering wand 2 such that mouth 55 trails bristles 50, the sprayed solution permeates the pile of the carpet with the resulting chemical reaction tending to loosen the dirt; such loosening is also aided by the force of the spray striking the pile of the carpet. As the bristles pass over the solution permeated carpet, a scrubbing action will occur due to both the passage of the bristles in the horizontal direction and the reciprocal vertical movement encouraged by the spring mounting plates. The suction developed at mouth 55, being relatively concentrated due to the rectangular or slit-like configuration of the mouth draws up the solution disposed within the pile of the carpet, the dirt suspended therein and any particulate matter embedded within the pile of the carpet.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A self contained carpet soil extractor for cleaning carpets, said soil extractor including a carrier, a wand and a hose assembly for interconnecting said carrier with said wand, said carrier having: (i) a first tank for storing a cleaning solution; (ii) a hinged cover extending across an upper opening of the first tank; (iii) a second tank for receiving waste water; (iv) a hinged sealable cover extending across an upper opening of the second tank; (v) a pump assembly for pumping the cleaning solution from the first tank under pressure; (vi) a vacuum pump assembly for creating a vacuum within the second tank; (vii) a power cord for transmitting electrical power to the pump assembly and the vacuum pump assembly from a source of electrical power; and (viii) wheels for transporting said carrier across a surface, said soil extractor comprising in combination:

a. said wand including a one piece head for supporting:
   1. means for dispensing the cleaning solution into the carpet;
   2. vertically reciprocable brush means for agitating the pile of the carpet;
   3. mouth means for drawing a mixture of the cleaning solution and dirt from the pile of the carpet; and
   4. support means for aiding in the transport of said wand across the pile of the carpet;

b. said hose assembly including:
   1. a first hose for conveying the cleaning solution from the pump assembly to said dispensing means within said wand; and
   2. a second hose for interconnecting the second tank with said mouth means within said wand;

c. said carrier including:
   1. switch means for energizing the pump assembly to convey the cleaning solution under pressure from the first tank through said hose assembly to said dispensing means and for energizing the vacuum pump assembly to establish a vacuum within the second tank and draw the mixture of cleaning solution and dirt into said mouth means within said wand, through said second hose and into the waste tank; and 2. hinge means for pivotally securing the waste tank to said carrier and accommodating tipping of the second tank to empty it; and d. normally closed valve means disposed within said wand for regulating the flow of cleaning solution from said first hose assembly through said dispensing means without affecting the continuing recovery of the mixture of cleaning solution and dirt to dry the carpet.

2. The soil extractor as set forth in claim 1 wherein said dispensing means comprises a plenum chamber disposed within said head, an inlet orifice assembly for introducing the cleaning solution to said plenum chamber from said first hose and a plurality of outlet nozzles for discharging the cleaning solution from said plenum chamber into the pile of the carpet.

3. The soil extractor as set forth in claim 2 wherein said outlet nozzles are oriented toward said brush means for discharging the cleaning solution in proximity to said brush means.

4. The soil extractor as set forth in claim 2 wherein said mouth means includes a fan-shaped passageway having a slot shaped inlet defining said mouth means and an outlet disposed at the apex of said passageway in fluid communication with said second hose.

5. The soil extractor as set forth in claim 4 wherein said brush means includes:

a. a plurality of downwardly oriented bristles; and b. resilient plate means for maintaining general vertical orientation of said bristles while accommodating reciprocal vertical movement of said bristles.

6. The soil extractor as set forth in claim 5 wherein said support means comprises a pivot point for bringing said head into and out of engagement with the pile of the carpet.

7. The soil extractor as set forth in claim 6 wherein said head extends in one direction transverse to the pivotal axis of said support means and wherein said wand includes a handle extending from said head for manually directing said wand across the carpet, said handle being extended in another direction transverse to the axis of said support means and opposite to the direction of extension of said head.

8. The soil extractor as set forth in claim 7 wherein said head is of a greater weight than said handle for pivotally biasing said head about said support means toward the pile of the carpet.

9. The soil extractor as set forth in claim 8 including weight means disposed within said head for increasing the bias of said head against the pile of the carpet.

10. The soil extractor as set forth in claim 9 including a sight window in said wand for viewing the mixture of cleaning solution and dirt flowing through said wand.

11. The soil extractor as set forth in claim 8 wherein said mouth means, the lower extremity of said bristles and the lower extremity of said support means are generally disposed in a common plane.

* * * * *